United States Patent [19]

Sanders, Jr. et al.

[11] Patent Number: 4,563,102

[45] Date of Patent: Jan. 7, 1986

[54] ROTATABLE APPARATUS FOR STORING PAPER FORMS FOR FEEDING TO A PRINTER

[76] Inventors: Edward L. Sanders, Jr.; Edward L. Sanders, III, both of P.O. Box N, La Plata, Md. 20646

[21] Appl. No.: 543,950

[22] Filed: Oct. 20, 1983

[51] Int. Cl.[4] ..... B41J 29/02

[52] U.S. Cl. ..... 400/691; 312/208; 312/252; 400/613.2

[58] Field of Search ..... 400/613.2, 613.3, 613.4, 400/691; 312/40, 41, 50, 59, 184, 208, 252, 254, 305; 211/55, 126; 248/146, 152, 160, 174, 247, 248, 346, 349, 676, 678

[56] References Cited

U.S. PATENT DOCUMENTS

| | | | |
|---|---|---|---|
| 1,319,302 | 10/1919 | Nicks | 211/163 |
| 1,417,472 | 5/1922 | Marsh | 400/609 |
| 1,615,894 | 2/1927 | Waldheim | 312/252 X |
| 1,616,071 | 2/1927 | Waldheim | 312/39 |
| 1,670,027 | 5/1928 | Eliasson | 400/82 |
| 1,724,936 | 8/1929 | Imbus | 400/613.2 X |
| 1,810,941 | 6/1931 | Blomberg | 211/44 |
| 2,219,762 | 10/1940 | Burdick et al. | 400/691 X |
| 2,267,502 | 12/1941 | Lewis | 197/126 |
| 2,610,723 | 9/1952 | Fleischmann et al. | 400/613.4 |
| 2,750,051 | 6/1956 | Wassell | 211/131 |
| 2,821,454 | 1/1958 | Gardner | 312/252 |
| 3,056,506 | 10/1962 | Fuller et al. | 211/1.6 |
| 3,933,400 | 1/1976 | Helgeson | 312/252 X |
| 3,992,068 | 11/1976 | Galton | 312/202 |
| 4,030,608 | 6/1977 | Howard | 211/131 |
| 4,059,256 | 11/1977 | Palmer | 270/52 |
| 4,241,964 | 12/1980 | Grubb, Jr. | 312/252 X |
| 4,431,238 | 2/1984 | Evans | 312/252 X |

*Primary Examiner*—Ernest T. Wright, Jr.

*Attorney, Agent, or Firm*—Wenderoth, Lind & Ponack

[57] ABSTRACT

An apparatus for storing prefolded paper forms to be fed to a business machine, such as a computer, printer, or the like, including a turntable rotatable horizontally about a vertical axis. The turntable contains divided shelves to hold various types and sizes of forms and rotates to align same for continuous feeding into the computer, printer, or the like. The turntable can be manually indexed or by utilization of a switching device and an electric motor, can be made to be power indexed.

11 Claims, 9 Drawing Figures

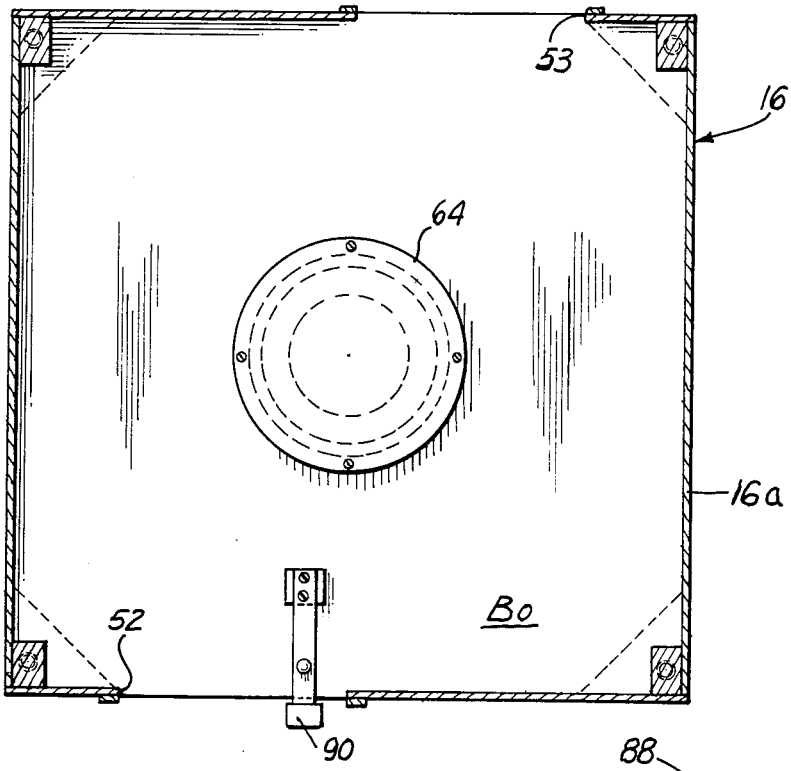
Fig. 6
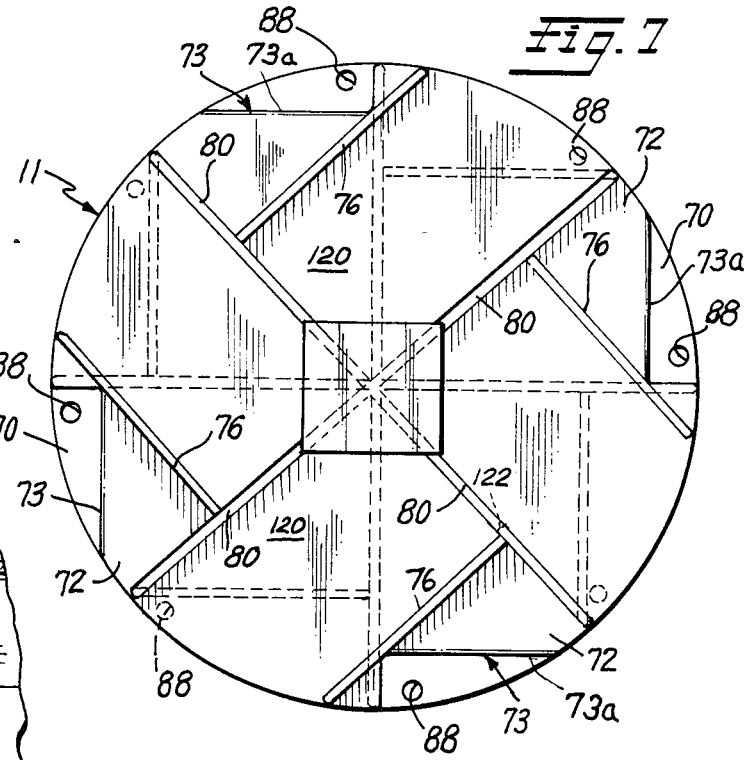
Fig. 7
Fig. 8
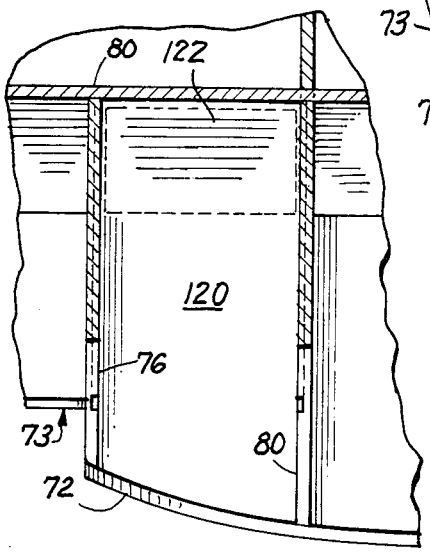

ROTATABLE APPARATUS FOR STORING PAPER FORMS FOR FEEDING TO A PRINTER

BACKGROUND OF THE INVENTION

This invention relates generally to an improved storing apparatus capable of storing various sized folded paper forms in an efficient and space-conserving structure so they can be readily fed to a printer or the like. The ready adjustability and adaptability to accommodate either front or rear load printers is another important feature.

The device is shown as a two-tiered structure in the drawings but could be three or more if so desired. The present two-tiered structure provides easy passage through the standard doorway when turned 90° to its side.

As this invention may be embodied in several forms without departing from the spirit or central characteristics thereof, the present embodiment is, therefore, illustrative and not restrictive, since the scope of the invention is defined by the appended claims rather than the description proceeding them, and all changes that fall within the metes and bounds of the claims or that form their functional as well as conjointly cooperative equivalence are, therefore, intended to be embraced by these claims.

OBJECTS OF THE INVENTION

The present invention provides an apparatus for storing prefolded business forms and the like for feeding them to a computer printer or the like from a turntable type storage means containing a plurality of sources of said forms. The instant invention can be enclosed within a cabinet with proper openings for feeding of the forms upon indexing to the specific form desired.

Manual or power means may be utilized to index the device and any well-known stop or detent mechanism can be utilized to lock the storage means in the desired feed position. The device can be constructed for either left hand or right hand paper discharge. Cabinet openings can be constructed for loading and discharging of paper to satisfy the type of feed required for the printer or the like.

Any well-known means may be utilized, such as a roller, on the cabinet top to accommodate paper feed.

A box with adjustable shelves may be inserted into any one of the sections of the rotatable trays to accommodate several paper forms in lieu of a full load of one form therein.

BRIEF DESCRIPTION OF THE DRAWINGS

FIG. 6 is a horizontal section view, through the cabinet, taken on the line 6—6 of FIG. 4;

FIG. 7 is a plan view of a modification of the rotary storing means showing the compartments for the continuous forms having an opposite dispensing arrangement than that of FIG. 3;

FIG. 8 is a perspective view partly in section, and taken in the direction of arrows 8 in FIG. 9, of a modification of one of the compartments wherein the rear wall is provided with a knock-out portion to accommodate larger continuous forms; and FIG. 9 is a sectional view of part of the shelf assembly showing the direction in which FIG. 8 is taken.

DETAILED DESCRIPTION OF THE PREFERRED EMBODIMENTS

Figure 1:
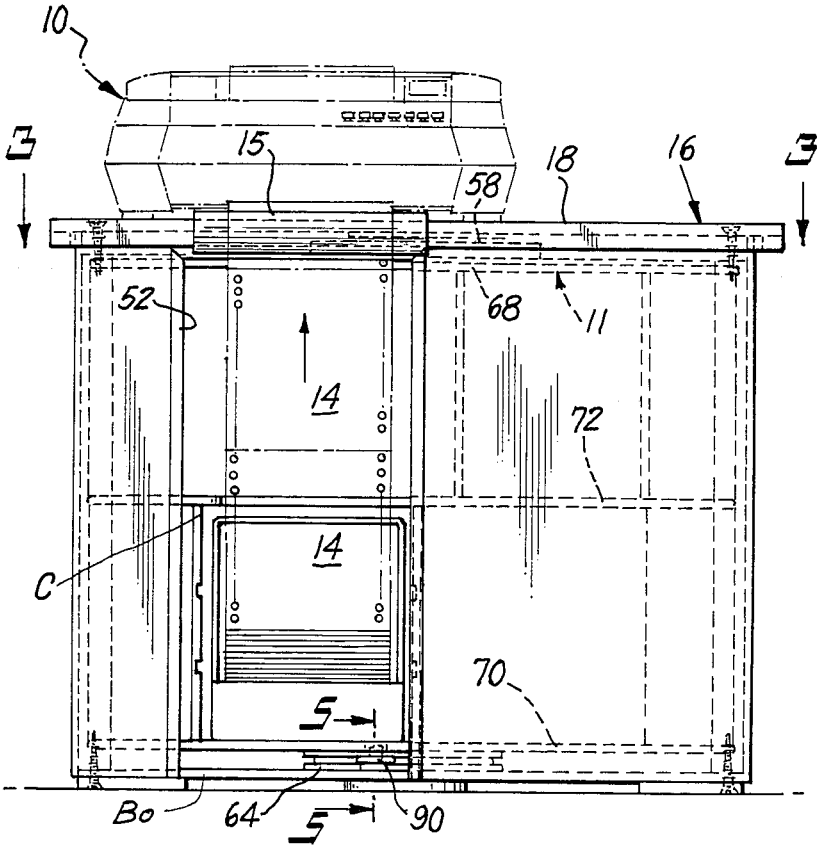
FIG. 1 is a front elevational view of the storing apparatus according to the present invention.
Figure 2:
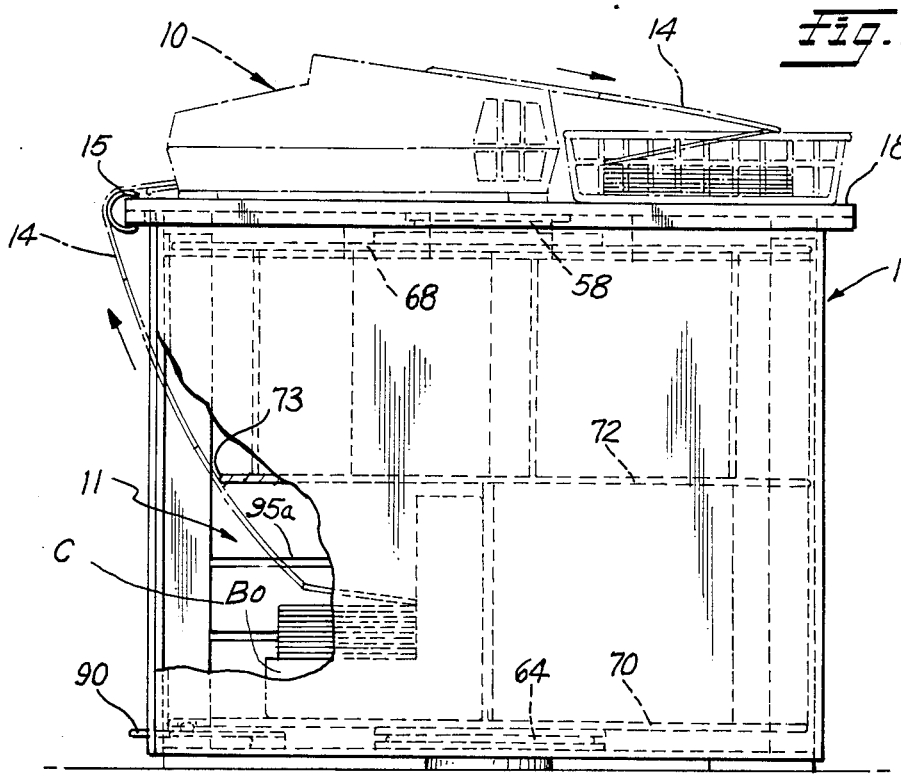
FIG. 2 is a side elevational view, partly broken away of the apparatus of FIG. 1.
Figure 3:
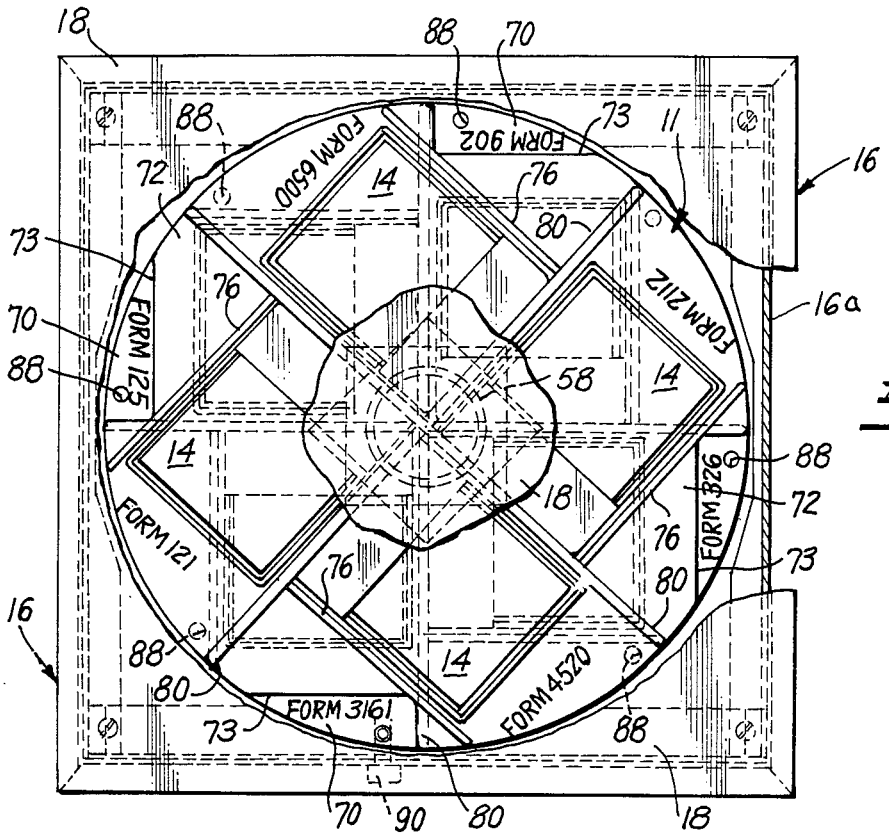
FIG. 3 is a plan view, partly broken away of the apparatus, taken on the line 3—3 of FIG. 1.
Figure 4:
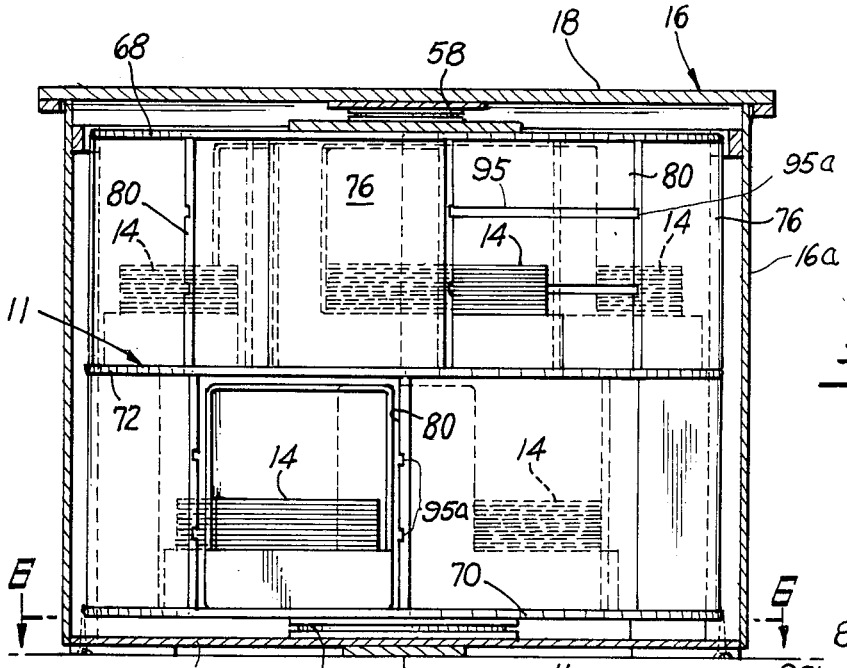
FIG. 4 is a vertical sectional view through the cabinet, with the rotary storage means shown in elevation.
Figure 5:
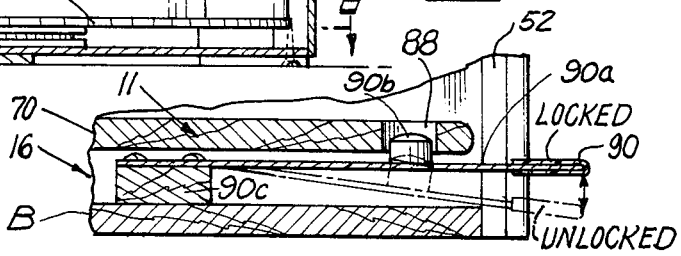
FIG. 5 is an enlarged fragmentary vertical sectional view, through the locking mechanism, taken on the line 5—5 of FIG. 1.
Figure 9:
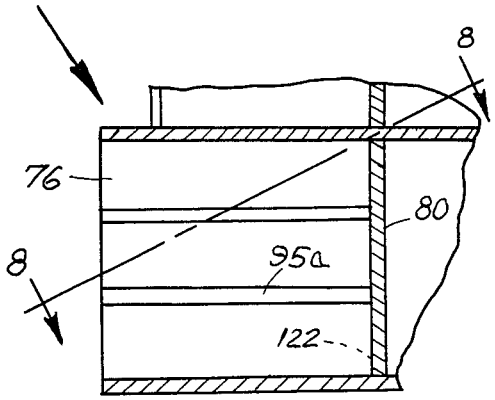

Referring to FIG. 1, in accordance with one embodiment of the invention, the apparatus comprises rotary shelf assembly 11 enclosed in a cabinet 16, having a bottom Bo and a top 18 for mounting thereon a printer or like means 10 for operating on manifolded forms 14. Openings 52 for front feed and 53 for rear feed extend from the top to the bottom of the sidewalls 16*a* of the cabinet 16 and parts of the shelf assembly 11 are held aligned therewith by the indexing and locking means 90, FIG. 5. Openings 88 in bottom shelf 70 cooperate with locking means 90. The locking means 90 has an arm 90*a* (see FIG. 5) having a pin 90*b* thereon at a position corresponding to the position of the openings 88. The arm 90*a* is pivotable about mounting piece 90*c* for moving the pin 90*b* into the openings 88 to lock the shelf assembly 11 in a corresponding rotational position and out of the openings 88 to free the shelf assembly 11 for rotation. Ball bearing assemblies 58 and 64 are utilized to support the rotatable shelf assembly 11 within the cabinet 16.

The shelf assembly 11 has a plurality of shelves 70, 72, one above the other, here shown as an intermediate shelf 72 and a bottom shelf 70, both circular. Each shelf 70, 72 has sidewalls 76 and 80 thereon which form compartments C for stacking of various types and sizes of forms 14 and the sidewalls 76 and 80 on each shelf other than the uppermost shelf support the next higher shelf. In the embodiment shown, the sidewalls 76 and 80 on the bottom shelf 70 support intermediate shelf 72. Sidewalls 76 and 80 on the uppermost shelf, which here is the intermediate shelf 72, support a top 68. The sidewalls 80 extend diametrically and transversely on the shelf 70 and intersect at the center of the shelf 70. They extend outwardly at least a distance equal to the length of the forms 14 to be stored, and here are shown extending to the edge of the shelf 70. The sidewalls 76 are offset from the sidewalls 80, one being on one side of a sidewall 80 and the other on the opposite side of the sidewall 80, and they are spaced outwardly from the intersection a distance such as to accommodate the width of the forms 14, i.e. just slightly greater than the width of the forms 14. They are perpendicular to the sidewall 80 and parallel to the other sidewall 80. With the sidewalls 80 they define compartments 120 for accommodating the forms 14 and which open laterally of the shelf assembly 11. The ball bearing assemblies 58 and 64 are at the centers of the top 68 and bottom shelf 70 to rotatably support the shelf assembly 11 for rotation around a vertical axis through the centers of the shelves 70 and 72.

Further accommodation for various size forms may be had by utilizing compartment shelves 95 slidable into grooves 95*a* in sidewalls 76 and 80; or inserts consisting of a box B into any of the compartments of the rotary shelf assembly.

Intermediate shelf 72 and bottom shelf 70 are circumferentially offset from one another to provide free feed from the bottom shelf 70 to the printer 10. Cutouts 73 in intermediate shelf 72 are provided for clearance of the paper feed from the lower shelf 70. The cutouts 73 have an edge 73*a* extending parallel to the sidewall 80 which forms the innermost sidewall defining the associated lower compartment 120, i.e. the sidewall 80 at the back of the associated lower compartment 120.

Guide means 15 are utilized to aid in the feed of the continuous forms 14 to the printer 10 or the like.

Knockout portion 122 may be provided as shown in compartment 120 in FIG. 8. This feature will accommodate extra large forms that may be utilized.

We claim:

1. A storing apparatus for storing forms to be fed to a means for operating on the forms, comprising:

a rotatable shelf assembly comprising a plurality of horizontal shelves one above the other;

a plurality of sidewalls on each shelf, the sidewalls on each shelf other than the top shelf supporting the next higher shelf; said sidewalls consisting of diametrically transverse sidewalls intersecting at the center of each shelf at right angles to each other, and extending outwardly of the shelf a distance at least equal to the length of the forms to be stored, and diametrically offset perpendicular sidewalls, one on each side of each diametrically transverse sidewall and spaced outwardly from the intersection of said diametrically transverse sidewalls a distance just slightly greater than the width of the forms to be stored and extending perpendicular to one diametrically transverse sidewall and parallel to the other diametrically transverse side wall to define with said diametrically transverse sidewalls compartments for accommodating the forms and which open laterally of said shelf assembly;

bearing means at least beneath the bottom shelf and rotatably supporting said shelf assembly for rotation around a vertical axis through the centers of the shelves; and support means above said shelf assembly for supporting the means for operating on the forms.

2. A rotary storing apparatus as claimed in claim 1 further comprising a top on the sidewalls on the uppermost shelf.

3. A rotary storing apparatus as claimed in claim 1 in which the sidewalls on one shelf are circumferentially offset from the sidewalls on the other shelves.

4. A rotary storing apparatus as claimed in claim 3 in which the shelves above the lowermost shelf each have cutouts in the edge of the shelf above the position at which the compartments on the lower shelf open laterally, said cutouts having an edge extending parallel to the diametrically transverse sidewall which forms the innermost sidewall defining the compartment above which the cutout is positioned.

5. A rotary storing apparatus as claimed in claim 1 in which the diametrically transverse sidewall which forms the innermost sidewall defining at least one compartment has a knockout portion therein which is removable to extend the compartment beyond said diametrically transverse sidewall.

6. A rotary storing apparatus as claimed in claim 1 further comprising a locking means engageable with said shelf assembly for locking said shelf assembly in a rotational position.

7. A rotary storing apparatus as claimed in claim 6 in which the bottom shelf of said shelf assembly has a plurality of openings therein spaced through the circumference thereof, and said locking means comprises an arm beneath said bottom shelf having a pin at a position corresponding to the position of said openings, said arm being movable toward and away from said bottom shelf for moving said pin into respective ones of said openings to lock the shelf assembly in a corresponding rotational position and out of said openings to free the shelf assembly for rotation.

8. A rotary storing apparatus as claimed in claim 1 further comprising a cabinet surrounding said shelf assembly and in which said shelf assembly is rotatably mounted, said support means being the top of said cabinet, said cabinet having sidewalls with at least one opening therein extending from the top to the bottom of said cabinet through which forms from said shelf assembly can be fed to the means for operating on the forms.

9. A rotary storing apparatus as claimed in claim 1 further comprising guide means mounted on said cabinet above said opening for guiding forms from the compartments in said shelf assembly to said means for operating on the forms.

10. A rotary storing apparatus as claimed in claim 8 in which said cabinet has a bottom, and the bottom shelf of said shelf assembly has a plurality of apertures therein spaced around the circumference thereof, and further comprising locking means constituted by an arm pivotally mounted on said cabinet bottom and having a pin thereon at a position corresponding to the position of said apertures, said arm being pivotable toward and away from said bottom shelf for moving said pin into respective ones of said apertures to lock the shelf assembly in a corresponding rotational position and out of said apertures to free the shelf assembly for rotation.

11. A rotary storing apparatus as claimed in claim 1 in which said sidewalls in at least one compartment have horizontal grooves therein and said apparatus further comprising compartment shelves inserted in said grooves.

* * * * *